United States Patent [19]

Lewis et al.

[11] 4,402,928

[45] Sep. 6, 1983

[54] CARBON FIBER PRODUCTION USING HIGH PRESSURE TREATMENT OF A PRECURSOR MATERIAL

[75] Inventors: Irwin C. Lewis, Strongsville; Arthur W. Moore, North Olmstead, both of Ohio

[73] Assignee: Union Carbide Corporation, Danbury, Conn.

[21] Appl. No.: 248,269

[22] Filed: Mar. 27, 1981

[51] Int. Cl.[3] ..... D01F 9/14; C10C 3/00

[52] U.S. Cl. ..... 423/447.1; 208/22; 208/39; 208/40; 208/45; 264/29.2; 423/447.2; 423/447.4; 423/447.6

[58] Field of Search ..... 423/447.4, 447.2, 447.1, 423/447.6, 447.7; 264/29.2; 208/45, 39, 40, 44, 41, 42, 22

[56] References Cited

U.S. PATENT DOCUMENTS

| | | | |
|---|---|---|---|
| 3,928,169 | 12/1975 | Conroy | 208/40 |
| 4,177,132 | 12/1979 | Uemura et al. | 208/40 |
| 4,184,942 | 1/1980 | Angier et al. | 208/44 |
| 4,208,267 | 6/1980 | Diefendorf et al. | 208/22 |
| 4,231,857 | 11/1980 | Kato et al. | 208/40 |

FOREIGN PATENT DOCUMENTS

| | | | |
|---|---|---|---|
| 870279 | 6/1961 | United Kingdom | 208/40 |

*Primary Examiner*—Edward J. Meros
*Attorney, Agent, or Firm*—David Fink

[57] ABSTRACT

A process for producing a carbon fiber includes the steps of heat treating a selected precursor material under high pressure, thereafter solvent extracting the treated precursor material to obtain mesophase pitch, spinning the mesophase pitch into at least one pitch fiber, thermosetting the pitch fiber, and carbonizing the pitch fiber to obtain the carbon fiber.

31 Claims, 1 Drawing Figure

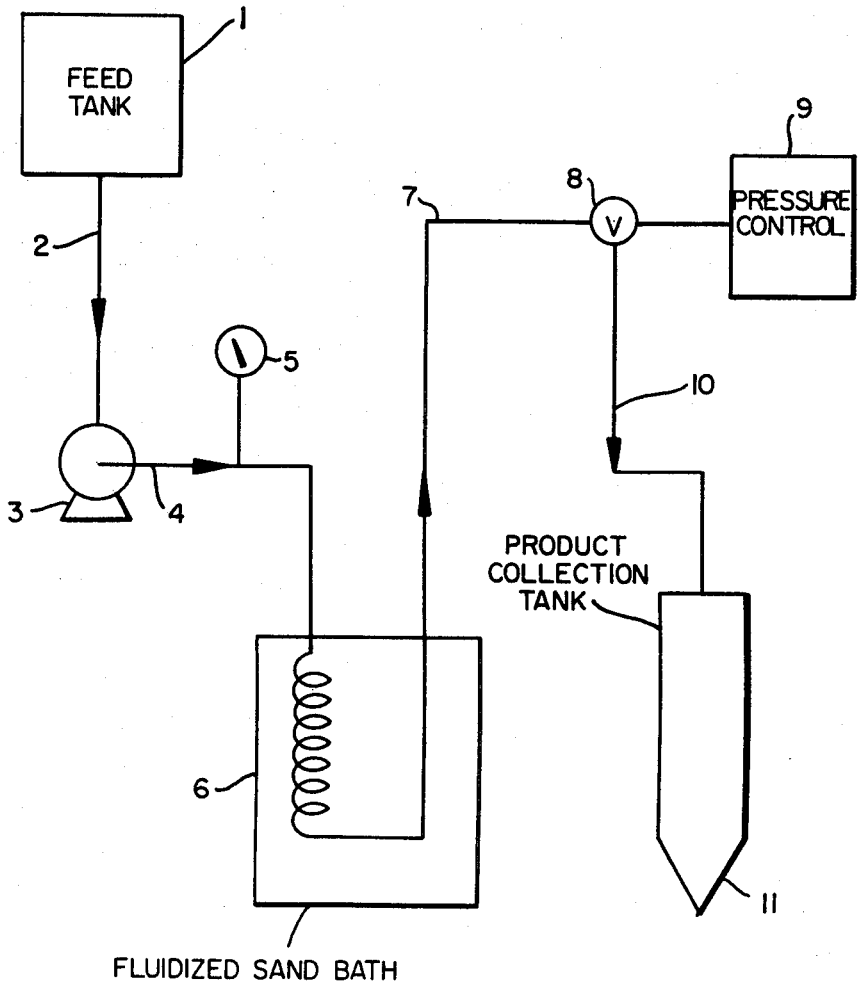
FEED TANK
1
2
3
4
5
6
7
8
V
9
PRESSURE CONTROL
10
PRODUCT COLLECTION TANK
11
FLUIDIZED SAND BATH

CARBON FIBER PRODUCTION USING HIGH PRESSURE TREATMENT OF A PRECURSOR MATERIAL

The invention relates to a process for producing a carbon fiber and particularly for producing an excellent carbon fiber from a selected precursor material which would not otherwise be suitable for forming a highly oriented carbon fiber according to prior art processes.

It is well known that carbon fibers having excellent properties suitable for commercial exploitation can be produced from mesophase pitch. The mesophase pitch derived carbon fibers are lightweight, strong, stiff, electrically conductive, and both chemically and thermally inert. The mesophase derived carbon fibers perform well as reinforcements in composites and have found use in aerospace applications and quality sporting equipment.

Generally, carbon fibers have been primarily made commercially from three types of precursor materials: rayon, polyacrylonitrile (PAN), and pitch. The use of pitch as a precursor material is attractive economically.

Low-cost carbon fibers produced from isotropic pitch fibers exhibit little preferred molecular orientation and relatively poor mechanical properties.

In contrast, carbon fibers produced from mesophase pitch exhibit high preferred molecular orientation and relatively excellent mechanical properties.

As used herein, the term "pitch" is to be understood as used in the instant art and generally refers to a carbonaceous residue consisting of a complex mixture of primarily aromatic organic compounds which are solid at room temperature and exhibit a relatively broad melting or softening temperature range. When cooled from the melt, the pitches behave as glasses.

As used herein, the term "mesophase" is to be understood as used in the instant art and generally is synonymous with liquid crystal. That is, a state of matter which is intermediate between crystalline solid and a normal liquid. Ordinarily, material in the mesophase state exhibits both anisotropic and liquid properties.

As used herein, the term "mesophase pitch" is a pitch containing more than about 40% by weight mesophase and is capable of forming a continuous anisotropic phase when dispersed by agitation or the like in accordance with the prior art.

One conventional method for preparing mesophase pitch suitable for forming a highly oriented carbon fiber is by the thermal treatment of a selected precursor pitch at a temperature greater than about 350° C. to effect thermal polymerization. This thermal polymerization process produces large molecular weight molecules capable of forming mesophase.

The criteria for selecting a suitable precursor material for the thermal polymerization process is that the precursor pitch can form a homogeneous bulk mesophase pitch having large coalesced domains under quiescent conditions. The mesophase pitch domains of aligned molecules must be in excess of about 200 microns in order to provide satisfactory spinning qualities to the mesophase pitch. This is generally set forth in the U.S. Pat. No. 4,005,183 to Singer.

A typical thermal polymerization process is carried out using reactors maintained at about 400° C. for from about 10 to about 20 hours. The properties of the final material can be controlled by the reaction temperature, thermal treatment time, and volatilization rate. The presence of the high molecular weight fraction results in a melting point of the mesophase pitch of at least about 300° C. An even higher temperature is needed to transform the mesophase pitch into fibers. This is termed "spinning" in the art.

Another process for obtaining mesophase pitch is by solvent extraction and is described in the co-pending patent application Ser. No. 079,891, Sept. 28, 1979, now abandoned.

The amount of mesophase in a pitch can be evaluated by known methods using polarized light microscopy. The presence of homogeneous bulk mesophase regions can be visually observed by polarized light microscopy, and quantitatively determined by known methods. Previously, the criteria of insolubility in certain organic solvents such as quinoline and pyridine was used to estimate mesophase content.

For prior art processes, there could be present in the precursor pitch certain non-mesophase insolubles and it is necessary to remove these insolubles before treating the precursor pitch to transform it to mesophase pitch. The presence of such non-mesophase insolubles interferes with the formation of spinnable mesophase pitch and can cause problems during the spinning operations.

The polarized ligh microscopy method can also be used to measure the average domain size of a mesophase pitch. For this purpose, the average distance between disclination lines is measured and defined as the average domain size. To some degree, domain size increases with temperature up to about coking temperature. As used herein, domain size is measured for samples quiescently heated, without agitation, to about 400° C.

In accordance with the prior art, "% P.I." refers to pyridine insolubles of a pitch by Soxhlet extraction in boiling pyridine at about 115° C.

Softening point or softening temperature of a pitch is related to its molecular weight constitution. The presence of a large amount of high molecular weight components generally tends to raise the softening temperature. It is a common practice in the art to characterize in part a precursor pitch by its softening point. For mesophase pitches, the softening point is used to determine suitable spinning temperature. Generally, the spinning temperature is about 40° C. or more higher than the softening temperature.

Generally, there are several methods for determining the softening temperature and the temperatures measured by these different methods vary somewhat from each other.

Generally, the Mettler softening point procedure is widely accepted as the standard for evaluating precursor pitches. This procedure can be adapted for use on mesophase pitches.

The softening temperature of a mesophase pitch can also be determined by hot stage microscopy. In this method, the mesophase pitch is heated on a microscope hot stage in an inert atmosphere under polarized light. The temperature of the mesophase pitch is increased under a controlled rate and the temperature at which the mesophase pitch commences to deform is noted as the softening temperature.

As used herein, softening point or softening temperature will refer to the temperature determined by the Mettler procedure for both precursor and mesophase pitches.

One principal embodiment of the invention is a process for producing a carbon fiber, comprising the steps of: selecting a precursor material from the group consisting of ethylene tars, ethylene tar distillates, gas oils derived from petroleum refining, gas oils derived from petroleum coking, aromatic hydrocarbons, and coal tar distillates having at least about 50% by weight which boils under about 300° C. and at least 70% by weight which boils under about 360° C.; subjecting the material to a thermal pressure treatment as a batch treatment at a temperature from about 400° C. to about 475° C. and at a pressure from about 200 psig to about 1500 psig to obtain a precusor pitch; solvent extracting the precursor pitch until there is obtained an insoluble portion having a molecular weight distribution wherein at least about 75% of the molecules have a molecular weight in the range of from about 600 to about 1300, less than about 10% of the molecules have a molecular weight less than about 600, and less than about 15% of the molecules have a molecular weight of more than about 1300; whereby the insoluble portion is a mesophase pitch containing at least about 70% by weight mesophase; spinning the mesophase pitch into at least one pitch fiber; and converting the pitch fiber into the carbon fiber.

Preferably, the batch treatment is carried out wherein the soaking volume factor is from about 0.4 to about 8.6.

Preferably, the batch treatment is continued until the Conradson carbon content of the precursor pitch is from about 20% to about 65%, more preferably at least about 30%.

Preferably, the batch treatment is carried out with the precursor material being agitated, for example, by stirring.

Preferably, the batch treatment is followed by a distilling step in order to raise the melting point of the precursor pitch to a predetermined temperature.

Preferably, the distilling is carried out to raise the Conradson carbon content of the precursor pitch to at least about 40%.

Another principal embodiment of the invention is a process for producing a carbon fiber, comprising the steps of: selecting a precursor material from the group consisting of ethylene tars, ethylene tar distillates, gas oils derived from petroleum refining, gas oils derived from petroleum coking, aromatic hydrocarbons, and coal tar distillates having at least 50% by weight which boils under about 300° C. and at least about 70% by weight which boils under 360° C.; subjecting the material to a continuous treatment at a temperature from about 420° C. to about 550° C. and at a pressure from about 200 psig to about 1500 psig to produce a precursor pitch; solvent extracting the precursor pitch until there is obtained an insoluble portion having a molecular distribution wherein at least about 75% of the molecules have a molecular weight in the range of from about 600 to about 1300, less than about 10% of the molecules have a molecular weight less than about 600, and less than about 15% of the molecules have a molecular weight of more than about 1300; whereby the insoluble portion is a mesophase pitch containing at least about 70% by weight mesophase; spinning the mesophase pitch into at least one pitch fiber; and converting the pitch fiber into the carbon fiber.

Preferably, the continuous treatment is carried out wherein the soaking volume factor is from about 0.4 to about 2.6.

Preferably, the continuous treatment is continued until the Conradson carbon content of the precursor pitch is from about 5% to about 65%, more preferably at least about 10%.

Preferably, the continuous treatment is carried out with the precursor pitch being agitated, for example, by stirring.

Preferably, continuous treatment is followed by a distilling step in order to raise the softening point of the precursor pitch to a predetermined temperature.

Preferably, the distilling is carried out until the Conradson carbon content of the precursor pitch is at least about 40%.

Further embodiments include the formation of a mesophase pitch through the use of either the batch treatment or the continuous treatment and including the various embodiments as set forth above.

The batch treatment and continuous treatment are set forth in detail in the co-pending application, Ser. No. 087,186, filed Oct. 22, 1979. That application has been allowed and its disclosure is incorporated herein by reference.

The severity of the heating under pressure can be evaluated by the term "soaking volume factor" which is a technical term widely used in the petroleum industry for such a purpose. A soaking volume factor of 1.0 is equivalent to 4.28 hours of heating at a temperature of about 427° C. under a pressure of about 750 psig. The effect of temperature on polymerization or cracking rate of hydrocarbons is known in the art. By way of example, the cracking rate at 450° C. is 3.68 times the cracking rate at 427° C. Most of the examples given herein were carried out at a temperature near 450° C. so that the thermal treatment severity was calculated on an equivalent basis for that temperature.

For a batch thermal-pressure treatment, the soaking volume factor range is from about 0.4 to about 8.6. The soaking volume factor is equivalent to from about 0.5 to about 10 hours at about 450° C.

The aromatic hydrocarbons include polynuclear aromatic hydrocarbons such as naphthalene, anthracene, and dimethylnaphthalene.

Agitation such as stirring the batch treatments provides a homogeneous distribution which results in an improved precursor pitch.

One of the important advantages of the invention is that the use of the precursor materials eliminates the problem of the presence of undersirable particles which could interfere with the production of high quality carbon fibers. Such particles include catalyst fines and finely divided carbon black particles. Conventional pitches present this problem. There is an important economic savings in eliminating the necessity of high temperature filtration to remove particles one micron and smaller which could interfere with the formation of high quality carbon fibers.

Any filtering of the instant precursor materials can be carried out easily because they are liquids at room temperatures.

The solvent extraction step is described in the co-pending application Ser. No. 079,891, filed Sept. 28, 1979, now abandoned and that disclosure is incorporated hereby by reference.

Generally, the solvents suitable for solvent extracting the precursor pitch include toluene, benzene, N,N-dimethyl formamide, a mixture of toluene and petroleum ether, and carbon disulfide.

The mesophase pitch resulting is characterized by having a molecular weight distribution which contains a single major peak as compared to the molecular weight distribution resulting from conventional thermal polymerization which contains two major peaks.

If the insolubles in the solvent extraction step are less than about 20% by weight, then a heat treatment and/or distilling at atmospheric or under a vacuum of the precursor pitch should be carried out in order to increase the insolubles and thereby improve the economics of the process. A softening point greater than about 120° C. is preferable.

Generally, a mesophase pitch for commercial spinning should have at least 70% by weight mesophase. The instant invention produced a mesophase pitch in which the mesophase and non-mesophase portions have relatively narrow molecular weight distributions and this usually results in good spinning operations. A mesophase pitch having a mesophase content in the range of from about 50% to about 60% by weight is believed to be spinnable and will probably produce good quality carbon fibers.

In carrying the invention into effect, certain embodiments have been selected for illustration in the accompanying drawing and for description in the specification.

The FIGURE shows a simplified flow diagram of the continuous thermal-pressure treatment system for use in carrying out the invention.

The FIGURE shows a simplified flow system in which precursor material is placed in a feed tank 1. The feed tank 1 can include heaters if desired for heating the precursor material to lower its viscosity and thereby improve its flow. The feed tank 1 is connected by a line 2 to a pump 3 which pumps the precursor material to line 4 and is monitored by a pressure gauge 5.

The precursor material moves to a furnace coil in a fluidized sandbath 6. If a longer treatment is desired, several fluidized sandbaths can be used in tandem.

The treated precursor material moves through line 7 to valve 8 which is controlled by a pressure control 9 and is collected line 10 in a product collection tank 11 for subsequent steps of the invention.

Illustrative, non-limiting examples of the invention are set out below. Numerous other examples can readily be evolved in the light of the guiding principles and teachings herein. The examples given herein are intended to illustrate the invention and not in any sense to limit the manner in which the invention can be practiced. The parts and percentages recited herein, unless specifically stated otherwise, refer to parts by weight and percentages by weight.

EXAMPLE 1

A petrochemical naphthalene was subjected to a batch thermal-pressure treatment at a temperature of about 500° C. for about 50 hours with the pressure rising to a maximum of about 1330 psig due to the pressure generated from the vapor pressure of the naphthalene and of the decomposition products. The yield of the precursor pitch from this treatment was about 75% by weight and had a Conradson carbon content of about 31%. The precursor pitch was examined using a hot stage microscope and it was determined that there was no mesophase present.

Although it did not appear necessary, the precursor pitch was filtered as a precaution to remove any solid contaminant which might have formed during the batch thermal-pressure treatment. The filtration was carried out using coarse (25–50 micron) sintered glass filter which was heated with heating tape to 80° C. A water aspiration vacuum suction was used.

This filtration is not at all as demanding as the filtration required for commercially available pitches.

An appropriate choice of parameters for the batch treatment can be selected to avoid the necessity of filtering.

The precursor pitch was then extracted at room temperature with toluene. The solvent extraction was carried out by stirring 80 grams of the pitch with 1200 ml of toluene for 3 hours. The insoluble portion was obtained by filtering through a Buchner funnel containing filter paper. For convenience, the insoluble portion was dried in a vacuum oven at 110° C. Air drying would have been satisfactory. The insoluble portion amounted to 25% by weight, had a Mettler softening point of about 285° C., and was 100% mesophase. The mesophase content was determined by melting the insoluble portion at a temperature of 300° C. and holding that temperature for ½ hour to anneal the insoluble portion. The annealed solid was mounted in an epoxy mount and observed under a polarized light microscope at 50× and 250× magnification.

For comparison, 20 grams of the precursor pitch was solvent extracted at room temperature, with an equal mixture of toluene and petroleum ether, 200 ml of each. The insoluble portion amounted to 26% by weight. It was determined by annealing the insoluble portion and examining it under a polarized light microscope that the insolubles contained about 80% by weight mesophase.

The relatively large change in mesophase content for the relatively small change in yield for the insoluble portion is surprising and should be taken into account in designing a system.

The mesophase pitch obtained from the solvent extraction using toluene was stirred at 350° C. for about ½ hour under nitrogen in order to remove residual toluene and thereafter spun into a mesophase pitch fiber having a diameter of about 20 microns. The fiber was thermoset by heating in air to about 375° C. at the rate of about 1° C. per minute and subsequently carbonized by heating to 1700° C. in an inert atmosphere in accordance with conventional practice. The carbon fiber obtained had a Young's modulus of $24\times10^6$ psi and a tensile strength $170\times10^3$ psi.

EXAMPLE 2

A commercial anthracene (98%) was heated under a pressure of 1000 psig at 440° C. for five hours. The precursor pitch obtained amounted to a 95% by weight yield, contained about 5% by weight mesophase, and had a Conradson carbon content of 56%.

The precursor pitch was then solvent extracted by stirring 60 grams of the precursor pitch with 1200 ml of toluene at room temperature for three hours and then filtered through a sintered glass funnel. The insoluble portion obtained amounted to 24% by weight and exhibited a Mettler melting point of about 203° C. It was determined that the mesophase content of the insoluble portion was 100% by weight.

EXAMPLE 3

A coal tar distillate (naphthalene still residue) having 63% by weight which boils under 300° C. and 80% by weight which boils under 360° C. was subjected to a temperature of about 450° C. at a pressure of about 750 psig for about five hours with stirring to produce a 78% by weight yield of a precursor pitch. The precursor pitch had a Conradson carbon content of about 24%. The precursor pitch was vacuum distilled to a final pot temperature of 380° C. at 10 mm pressure to provide a pitch having a softening point of about 237° C. The yield was 51%. This improved precursor pitch had a mesophase content of about 20% by weight.

The improved precursor pitch was then solvent extracted with toluene with the ratio of 1 gram to 10 ml at room temperature for one hour. The insoluble portion amounted to about 78% by weight and contained about 40% by weight mesophase.

For comparison, the solvent extraction was repeated except that the toluene had a temperature of about 80° C. The insolubles amounted to about 60% by weight and had a mesophase content of 100% by weight. The Mettler softening point of the insolubles was about 362° C.

EXAMPLE 4 (Best Mode)

An ethylene tar distillate from the steam cracking of naphtha with a boiling range of 190° C. to 380° C. was pressure treated in a continuous system at a pressure of 750 psig at a maximum temperature of 535° C. The soaking volume factor was about 1.1. The precursor pitch obtained had a Conradson carbon content of about 6.5% and amounted to a 97% by weight yield.

The precursor pitch was vacuum distilled at 1 mm mercury pressure to obtain a final vapor temperature of 240° C. The distilled pitch obtained amounted to a yield of 12.1% by weight. The distilled pitch was extracted with toluene at room temperature with a ratio of 1 gram per 10 ml and resulted in a yield of about 4.3% by weight of the insoluble portion. The mesophase content of the insoluble portion was measured to be about 65% by weight. A yield of this amount would probably be uneconomical for commercial use.

For comparison, the distilled pitch was heat treated at 390° C. for a period of three hours with agitation in a nitrogen atmosphere. Nitrogen sparging to the pitch was maintained at the rate of about 1 liter per minute for the last two hours and the resulting pitch amounted to 160 grams. This pitch amounted to a 72% by weight yield and had a softening point of about 189° C. This pitch was examined under a hot stage polarized light microscope and appeared to be completely isotropic. The pitch was then extracted with toluene at room temperature with a ratio of 1 gram per 10 ml and the insoluble portion obtained amounted to 35% by weight. The insoluble portion contained about 100% mesophase and had a Mettler softening point of about 322° C. This shows that a heat treatment can substantially improve the yield.

EXAMPLE 5

A gas oil having a boiling range of from about 250° C. to about 450° C. derived from a delayed petroleum coking operation was heated in a stirred pressure autoclave at a pressure of about 300 psig at a temperature of about 450° C. for about four hours. The precursor pitch obtained amounted to 80% by weight and had a Conradson carbon content of about 28%. This product was distilled by heating to 380° C. in an inert atmosphere to obtain a distilled pitch having a softening point of about 119° C. and with a yield of about 75% by weight. The distilled pitch had a mesophase content of about 5% by weight.

The distilled pitch obtained was then solvent extracted at room temperature with toluene by using a ratio of 1 gram of pitch to 10 ml toluene. The insoluble portion obtained amounted to a yield of about 38% by weight, had a mesophase content of about 95% by weight, and a softening point temperature of about 327° C.

EXAMPLE 6

An ethylene tar distillate from steam cracking of naphtha with a boiling range of about 200° C. to about 360° C. and a Conradson carbon value of 0.4% was pressure-treated in a batch pressure vessel with agitation at a pressure of about 800 psig at a temperature in the range of from about 430° C. to about 460° C. for about five hours. The precusor pitch obtained amounted to about 50% by weight and had a Conradson carbon content of about 26%. The precursor pitch was distilled by heating at atmospheric temperature with nitrogen sparging to obtain a distilled pitch having a final pot temperature of about 355° C. The distilled pitch obtained amounted to a 46% by weight yield and had a softening point of about 124° C. This pitch contained about 5% by weight mesophase.

The distilled pitch was solvent extracted with toluene at room temperature using a ratio of 1 gram of pitch to 10 ml toluene and resulted in a 44% by weight yield of the insoluble portion. The insoluble portion contained about 90% by weight mesophase and had a Mettler softening point of about 319° C.

EXAMPLE 7

An ethylene tar distillate having a boiling range of from about 210° C. to about 330° C. and a Conradson carbon content of 0.2% was pressure heat treated in a batch pressure vessel with agitation at a pressure of about 800 psig at a temperature range from about 440° C. to about 460° C. for about five hours. The heavy tar product obtained amounted to a 56% by weight yield and had a Conradson carbon content of about 19.7%. The tar product was distilled to obtain a pitch having a softening point of about 126° C. and a Conradson carbon content of about 57.7%. The distillation was performed by heating the tar product with agitation and nitrogen sparging to a final pot temperature of about 325° C. The yield of pitch was about 25% by weight.

The pitch was solvent extracted with toluene at room temperature using a ratio of 1 gram pitch to 10 ml toluene. The insoluble portion amounted to a 24% by weight yield, contained about 100% by weight mesophase, and had a Mettler softening point of about 317° C.

The high yields of mesophase pitch (24–44%) obtained by extraction of the 120° C. softening point petroleum pitches in examples 5, 6 and 7 is considerably higher than those obtained in the prior art by solvent extraction of conventional commercial 120° C. softening point petroleum pitches (8–14%).

Having thus described the invention, what we claim as new and desire to be secured by Letter Patent, is as follows:

1. A process for producing carbon fiber, comprising the steps of:

selecting a precursor material from the group consisting of ethylene tars, ethylene tar distillates, gas oils derived from petroleum refining, gas oils derived from petroleum coking, and aromatic hydrocarbons;

subjecting the material to a thermal-pressure treatment as a batch treatment at a temperature from about 400° C. to about 475° C. and at a pressure from about 750 psig to about 1500 psig to obtain a precursor pitch, the soaking volume factor of said treatment being at least 0.4.

solvent extracting the precursor pitch until there is obtained an insoluble portion having a molecular weight distribution wherein at least about 75% of the molecules have a molecular weight in the range of from about 600 to about 1300, less than about 10% of the molecules have a molecular weight less than about 600, and less than about 15% of the molecules have a molecular weight of more than about 1300;

whereby the insoluble portion is a mesophase pitch containing at least 70% by weight mesophase;

spinning the mesophase pitch into at least one pitch fiber; and converting the pitch fiber into the carbon fiber.

2. The process of claim 1, wherein the soaking volume factor for the thermal-pressure treatment is from about 0.4 to about 8.6.

3. The process of claim 2, wherein the thermal-pressure treatment is continued until the Conradson carbon content of the precursor pitch is from about 20% to about 65%.

4. The process of claim 3, wherein the Conradson carbon content is at least about 30%.

5. The process of claim 3, wherein the thermal-pressure treatment is carried out with the material being agitated.

6. The process of claim 5, wherein the agitation is in the form of stirring.

7. The process of claim 3, further comprising filtering the precursor pitch prior to the solvent extracting step to remove infusible solids.

8. The process of claim 3, further comprising distilling the precursor pitch to raise its softening point to a predetermined temperature.

9. The process of claim 8, wherein the temperature is at least about 120° C.

10. The process of claim 8, wherein the distilling is carried out to raise the Conradson carbon content of the precursor pitch to at least about 40%.

11. A process for producing a carbon fiber, comprising the steps of:

selecting a precursor material from the group consisting of ethylene tars, ethylene tar distillates, gas oils derived from petroleum refining, gas oils derived from petroleum coking, and aromatic hydrocarbons;

subjecting the material to a continuous treatment at a temperature from about 420° C. to about 550° C. and at a pressure from about 750 psig to about 1500 psig to produce a precursor pitch, the soaking volume factor of said treatment being at least 0.4;

solvent extracting the precursor pitch until there is obtained an insoluble portion having a molecular distribution wherein at least about 75% of the molecules have a molecular weight in the range of from about 600 to about 1300, less than about 10% of the molecules have a molecular weight less than about 600, and less than about 15% of the molecules have a molecular weight of more than about 1300;

whereby the insoluble portion is a mesophase pitch containing at least about 70% by weight mesophase;

spinning the mesophase pitch into at least one pitch fiber; and converting the pitch fiber into the carbon fiber.

12. The process of claim 11, wherein the soaking volume factor for the continuous treatment is from about 0.4 to about 2.6.

13. The process of claim 11, wherein the continuous treatment is carried out until the Conradson carbon content of the precursor pitch is from about 5% to about 65%.

14. The process of claim 13, wherein the Conradson carbon content is at least about 10%.

15. The process of claim 13, further comprising distilling the precursor pitch to raise its softening point to a predetermined temperature.

16. The process of claim 15, wherein the distilling step is carried out to raise the Conradson carbon content of the precursor pitch to at least about 40%.

17. Process for producing a mesophase pitch comprising the steps of:

selecting a precursor material from the group consisting of ethylene tars, ethylene tar distillates, gas oils derived from petroleum refining, gas oils derived from petroleum coking, and aromatic hydrocarbons;

subjecting the material to a thermal-pressure treatment as a batch treatment at a temperature from about 400° C. to about 475° C. and at a pressure from about 750 psig to about 1500 psig to obtain a precursor pitch, the soaking volume factor of said treatment being at least 0.4; and solvent extracting the precursor pitch until there is obtained an insoluble portion having a molecular weight distribution wherein at least about 75% of the molecules have a molecular weight in the range of from about 600 to about 1300, less than about 10% of the molecules have a molecular weight less than about 600, and less than about 15% of the molecules have a molecular weight of more than about 1300;

whereby the insoluble portion is the mesophase pitch containing at least 70% by weight mesophase.

18. The process of claim 17, wherein the soaking volume factor for the thermal-pressure treatment is from about 0.4 to about 8.6.

19. The process of claim 18, wherein the thermal-pressure treatment is continued until the Conradson carbon content of the precursor pitch is from about 20% to about 65%.

20. The process of claim 19, wherein the Conradson carbon content is at least about 30%.

21. The process of claim 19, wherein the thermal-pressure treatment is carried out with the material being agitated.

22. The process of claim 21, wherein the agitation is in the form of stirring.

23. The process of claim 20, further comprising distilling the precursor pitch to raise its softening point to a predetermined temperature.

24. The process of claim 23, wherein the temperature is at least about 120° C.

25. The process of claim 23, wherein the distilling is carried out to raise the Conradson carbon content of the precursor pitch to at least about 40%.

26. A process for producing a mesophase pitch, comprising the steps of:

selecting a precursor material from the group consisting of ethylene tars, ethylene tar distillates, gas oils derived from petroleum refining, gas oils derived from petroleum coking, and aromatic hydrocarbons;

subjecting the material to a continuous treatment at a temperature from about 420° C. to about 550° C. and at a pressure from about 750 psig to about 1500 psig to produce a precursor pitch, the soaking volume factor of said treatment being at least 0.4; and solvent extracting the precursor pitch until there is obtained an insoluble portion having a molecular distribution wherein at least about 75% of the molecules have a molecular weight in the range of from about 600 to about 1300, less than about 10% of the molecules have a molecular weight less than about 600, and less than about 15% of the molecules have a molecular weight of more than about 1300;

whereby the insoluble portion is the mesophase pitch containing at least about 70% by weight mesophase.

27. The process of claim 26, wherein the soaking volume factor for the continuous treatment is from about 0.4 to about 2.6.

28. The process of claim 26, wherein the continuous treatment is carried out until the Conradson carbon content of the precursor pitch is from about 5% to about 65%.

29. The process of claim 28, wherein the Conradson carbon content is at least about 10%.

30. The process of claim 28, further comprising distilling the precursor pitch to raise its softening point to a predetermined temperature.

31. The process of claim 30, wherein the distilling step is carried out to raise the Conradson carbon content of the precursor pitch to at least about 40%.

* * * * *